US010765586B2

(12) United States Patent
Liang et al.

(10) Patent No.: US 10,765,586 B2
(45) Date of Patent: Sep. 8, 2020

(54) WALKING AID DEVICE

(71) Applicant: Wistron Corporation, New Taipei (TW)

(72) Inventors: Chen-Yi Liang, New Taipei (TW); Cheng-Hsing Liu, New Taipei (TW); Ming-Ju Hsieh, New Taipei (TW); Chien-Wei Chen, New Taipei (TW)

(73) Assignee: Wistron Corporation, New Taipei (TW)

( * ) Notice: Subject to any disclaimer, the term of this patent is extended or adjusted under 35 U.S.C. 154(b) by 328 days.

(21) Appl. No.: 15/871,078

(22) Filed: Jan. 15, 2018

(65) Prior Publication Data

US 2019/0142684 A1 May 16, 2019

(30) Foreign Application Priority Data

Nov. 14, 2017 (TW) ..... 106139272 A

(51) Int. Cl.
*A61H 3/04* (2006.01)
*A61H 1/00* (2006.01)

(52) U.S. Cl.
CPC ..... *A61H 3/04* (2013.01); *A61H 1/00* (2013.01); *A61H 2003/043* (2013.01);
(Continued)

(58) Field of Classification Search
CPC ..... A61H 3/04; A61H 2003/043; A61H 2003/046; B60L 2200/24; G01C 21/206;
(Continued)

(56) References Cited

U.S. PATENT DOCUMENTS 6,536,544 B1 * 3/2003 Egawa ..... A61H 3/04 180/19.3
8,042,871 B2 10/2011 Lin
(Continued)

FOREIGN PATENT DOCUMENTS

CN 101647745 2/2010
CN 203677400 7/2014
(Continued)

*Primary Examiner* — Thomas G Black
*Assistant Examiner* — Sara J Lewandroski
(74) *Attorney, Agent, or Firm* — JCIPRNET

(57) ABSTRACT

A walking aid device including a moving body, a message receiving element, a positioning element, and a processor is provided. The message receiving element, the positioning element, and the processor are respectively disposed at the moving body, and the message receiving element and the positioning element are respectively electrically coupled to the processor. The message receiving element is configured to receive a message from a target, and the positioning element is configured to locate a position of the moving body. When the message from a target is received by the message receiving element, the processor determines an orientation of the target according to the message, and the positioning element locates the position of the moving body. The processor produces a position data according to the orientation of the target and the position of the moving body, and controls the moving body to move to where the target is located.

15 Claims, 11 Drawing Sheets

(52) U.S. Cl.
CPC ..... *A61H 2003/046* (2013.01); *A61H 2201/0161* (2013.01); *A61H 2201/0192* (2013.01); *A61H 2201/1215* (2013.01); *A61H 2201/1633* (2013.01); *A61H 2201/1635* (2013.01); *A61H 2201/5007* (2013.01); *A61H 2201/5025* (2013.01); *A61H 2201/5048* (2013.01); *A61H 2201/5058* (2013.01); *A61H 2201/5064* (2013.01); *A61H 2201/5069* (2013.01); *A61H 2201/5071* (2013.01); *A61H 2201/5084* (2013.01); *A61H 2201/5092* (2013.01); *A61H 2203/0406* (2013.01); *A61H 2203/0425* (2013.01)

(58) Field of Classification Search
CPC ..... G06K 2209/21; G05D 1/12; G01S 13/06; G01S 15/06; G01S 17/06
See application file for complete search history.

(56) References Cited

U.S. PATENT DOCUMENTS 9,510,992 B2 * 12/2016 Fu ..... A63B 71/0009
9,849,048 B2 12/2017 Borisoff et al.
10,245,937 B2 * 4/2019 Gillett ..... G05D 1/0278
2009/0148034 A1 * 6/2009 Higaki ..... G06K 9/3241 382/153
2009/0149991 A1 * 6/2009 Sumida ..... G06N 3/008 700/246
2011/0193305 A1 * 8/2011 Li ..... A61H 3/04 280/47.34
2013/0069344 A1 * 3/2013 Moliner ..... A61G 3/04 180/19.3
2013/0103226 A1 * 4/2013 Fu ..... G01S 17/93 701/1
2014/0365033 A1 * 12/2014 Masaki ..... B62B 5/0076 701/2
2015/0066325 A1 * 3/2015 Tanaka ..... A61H 3/04 701/70
2015/0075575 A1 * 3/2015 Karlovich ..... A61H 3/008 135/66
2015/0183482 A1 * 7/2015 Kubo ..... B62K 11/007 180/209
2015/0298764 A1 * 10/2015 Edlund ..... A61H 3/04 180/206.2
2015/0359691 A1 * 12/2015 Isozumi ..... A61H 3/04 180/19.1
2015/0359699 A1 * 12/2015 Chang ..... A61G 5/1094 701/22
2016/0296410 A1 * 10/2016 Paterson ..... A61H 3/04
2016/0299502 A1 * 10/2016 Chamberlain ..... G05D 1/0255
2016/0330402 A1 * 11/2016 Benetti ..... H04N 7/142
2017/0242504 A1 * 8/2017 Hanson ..... G06F 3/039
2017/0354564 A1 * 12/2017 Dirauf ..... G08B 21/0476
2018/0001946 A1 * 1/2018 Yokoya ..... G05D 1/0238
2018/0101179 A1 * 4/2018 Louey ..... B62K 5/027
2018/0289579 A1 * 10/2018 Agrawal ..... A61H 3/008
2019/0133869 A1 * 5/2019 Aflatoon ..... A61H 3/04
2020/0008990 A1 * 1/2020 Harrison ..... A61G 5/1024

FOREIGN PATENT DOCUMENTS

CN 104936569 9/2015
EP 3075369 A1 * 10/2016 ..... A61H 3/04
TW M245962 10/2004
TW I256301 6/2006
TW 201014726 4/2010

* cited by examiner

WALKING AID DEVICE

CROSS-REFERENCE TO RELATED APPLICATION

This application claims the priority benefit of Taiwan application serial no. 106139272, filed on Nov. 14, 2017. The entirety of the above-mentioned patent application is hereby incorporated by reference herein and made a part of this specification.

BACKGROUND

Technical Field

The invention is related to a walking aid device, and more particularly to, a multifunctional walking aid device.

Description of Related Art

In response to the market demand for rehabilitation and medical care, wheelchairs or walking aids are currently available to assist people who are not at ease to walk or in post-operative (post-illness) rehabilitation. Common wheelchairs are mainly for users to ride thereon, and to drive them by electric or manual means. Common walking aids are mainly for the users to hold onto handles thereof by both hands so as to enable the users to get a support during the walking process and to push the walking aids to move forwards, thereby reducing the burden during walking.

However, once the wheelchairs or the walking aids are too far from the users, the users must go to the wheelchairs or the walking aids on their own, or ask others to assist in moving the wheelchairs or the walking aids to where the users are located, and this is extremely troublesome for the users who are not at ease to walk.

SUMMARY

The invention is directed to a walking aid device with excellent ease of use.

The walking aid device of the invention includes a moving body, a message receiving element, a positioning element and a processor. The message receiving element, the positioning element and the processor are respectively disposed at the moving body, and the message receiving element and the positioning element are respectively and electrically coupled to the processor. The message receiving element is configured to receive a message from the target, and the positioning element is configured to located a position of the moving body. When the message receiving, element receives the message from the target, the processor determines an orientation of the target according to the message, and the positioning element locates the position of the moving body. The processor produces a position data according to the orientation of the target and the position of the moving body, and controls the moving body to move to where the target is located according to the position data.

In one embodiment of the invention, the walking aid device further includes at least one image sensor disposed at one side of the moving body and electrically coupled to the processor. The at least one image sensor is configured to obtain an image of the target, and the processor determines a distance, an orientation or a posture of the target according the image of the target obtained by the at least one image sensor.

In one embodiment of the invention, the walking aid device further includes a seat and a handle respectively movably connected to the moving body.

In one embodiment of the invention, the walking aid device further includes a first driving element and a second driving element respectively deposed at the moving body. The first driving element is connected to the seat to drive the seat to rotate relative to the moving body, wherein the first driving element is electrically coupled to the processor. The second driving element is connected to the handle to drive the handle to rotate relative to the moving body, wherein the second driving element is electrically coupled the processor.

In one embodiment of the invention, the walking aid device further includes a pressure sensing element disposed at the seat and electrically coupled to the processor. When the target applies a pressure onto the pressure sensing element, the processor controls the first driving element to drive the seat to rotate relative to the moving body according to a pressure value detected by the pressure sensing element.

In one embodiment of the invention, the walking aid device further includes pressure sensing element disposed at the handle and electrically coupled to the processor. When the target applies a pressure onto the pressure sensing element, the processor controls the second driving element to drive the handle to rotate relative to the moving body according to a pressure value detected by the pressure sensing element.

In one embodiment of the invention, the walking aid device further includes a pressure sensing element disposed at the handle and electrically coupled to the processor. When the target applies a pressure onto the pressure sensing element, the processor controls the second driving element to drive the handle to rotate relative to the moving body according to a pressure value detected by the pressure sensing element and the orientation and the posture of the target.

In one embodiment of the invention, the walking aid device further includes a first pressure sensing element and a second pressure sensing element. The first pressure sensing element is disposed at the seat and electrically coupled to the processor. The second pressure sensing element is disposed at the handle and electrically coupled to the processor. When the target applies a pressure onto the first pressure sensing element, the processor turns off a sensing function of the second pressure sensing element according to a pressure value detected by the first pressure sensing element and controls the first driving element to drive the seat to rotate relative to the moving body along a rotation direction, and until the seat rotates into position, the processor turns on the sensing function of the second pressure sensing element again. When the target simultaneously applies pressures onto the first pressure sensing element and the second pressure sensing element, the processor controls the moving body to move according to a pressure value detected by the first pressure sensing element and a pressure value detected by the second pressure sensing element.

In one embodiment of the invention, the walking aid device further includes a switch element disposed at the handle and electrically coupled to the processor. After the switch element is activated, the processor turns off the sensing function of the second pressure sensing element and stops the moving body from moving, and then controls the first driving element to drive the seat to rotate relative to the moving body along a direction opposite to the rotation direction, and until the seat rotates into position and the pressure applied onto the first pressure sensing element is removed, the processor turns on the sensing function of the second pressure sensing element again.

In one embodiment of the invention, after the processor determines the distance, the orientation and the posture of the target according to the image of the target obtained by the at least one image sensor while the message receiving element receives a command sent out by the target, the processor controls the moving body to move along the target according to the command.

In one embodiment of the invention, the moving body includes an active body, a driven body and a driving element, and the driven body is pivoted on the active body. The driving element is connected to the driven body and the active body, the driving element is electrically coupled to the processor. The driving element is configured to drive the driven body to rotate relative to the active body so as to adjust an expansion angle between the driven body and the active body.

In one embodiment of the invention, the walking aid device further includes a pair of drive assemblies connected to the active body and electrically coupled to the processor. The pair of drive assemblies operates under a control of the processor to drive the active body to move.

In one embodiment of the invention, the walking aid device further includes a proximity sensing element disposed at the active body and electrically coupled to the processor. The proximity sensing element is configured to detect obstacles around the moving body.

In one embodiment of the invention, the walking aid device further includes a tilt sensing element disposed at the active body and electrically coupled to the processor. The tilt sensing element is configured to detect obstacles around the moving body.

In one embodiment of the invention, the position data includes a map information around the target and the moving body.

In view of the above, the walking aid device of the invention can be controlled by the message from the target (e.g., a user) to move automatically from the far away to where the target is located, and thus is extremely convenient to use. On the other hand, the walking aid device of the invention may have a tracking function for moving along with the target (e.g., the user).

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
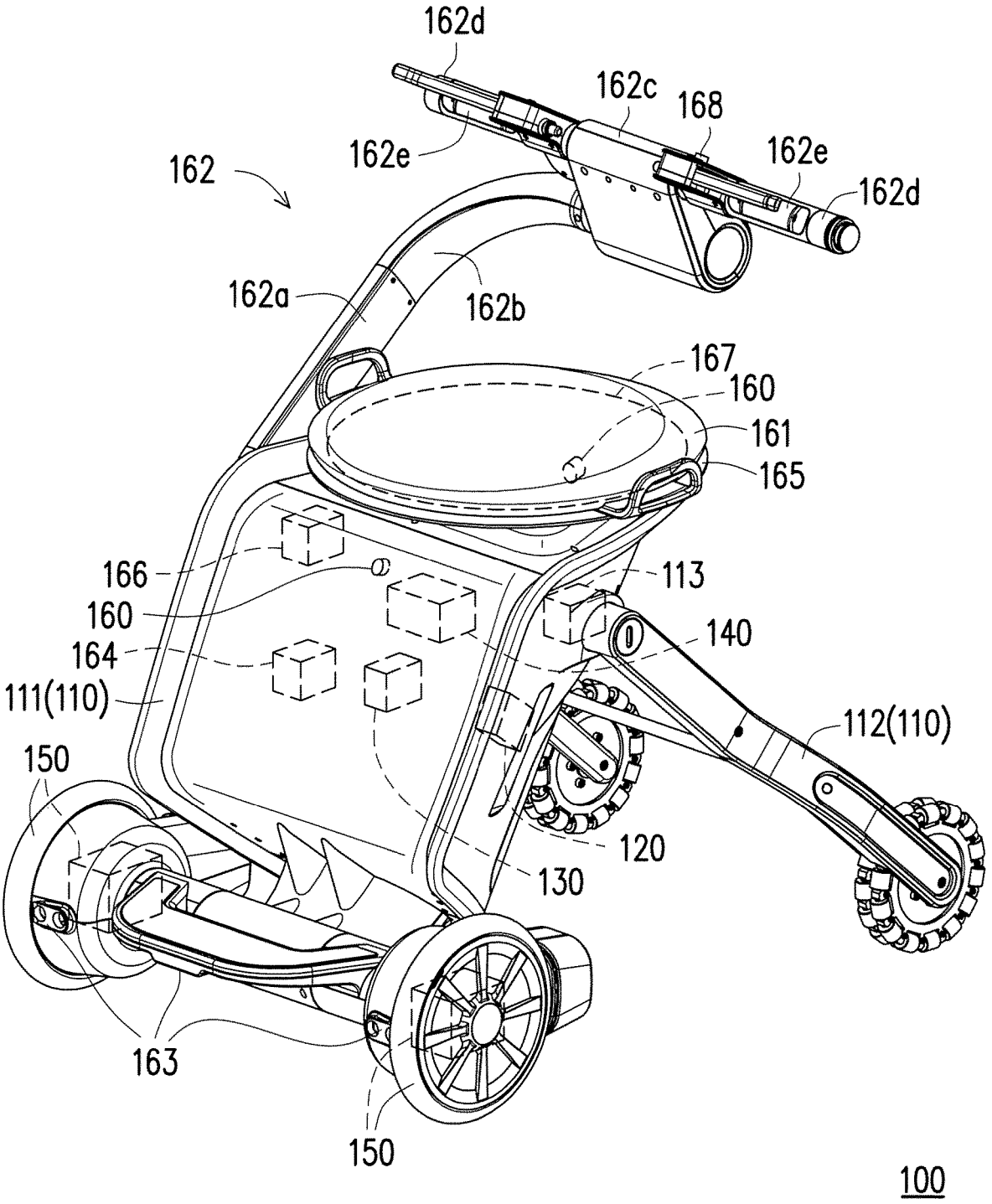
FIG. 1 is a schematic diagram illustrating a walking aid device according to an embodiment of the invention.

FIG. 1 is a schematic diagram showing a walking aid device according to an embodiment of the invention. Referring to FIG. 1, in the present embodiment, the walking aid device 100 can be used to carry a user (i.e., target 10, please refer to FIG. 9) or to guide the user (i.e., target 10, please refer to FIG. 4) to walk, and use modes thereof can be switched depending on actual needs of the user (i.e., target 10, please refer to any one of FIG. 2 through FIG. 10). The walking aid device 100 includes a moving body 110, a message receiving element 120, a positioning element 130 and a processor 140, wherein the message receiving element 120, the positioning element 130 and the processor 140 are respectively disposed at the moving body 110, and the message receiving element 120 and the positioning element 130 are respectively electrically coupled to the processor 140.

The moving body 110 may include an active body 111, a driven body 112 and a driving element 113, wherein the active body 111 and the driven body 112 are pivoted to each other and can rotate relative to each other, and the active body 111 can provide a power source for guiding the driven body 112 to move together. The message receiving element 120, the positioning element 130 and the processor 140 are respectively disposed at the active body 111, wherein the driving element 113 is electrically coupled to the processor 140 and disposed at the active body 111. Furthermore, the driving element 113 is connected to the driven body 112 and the active body 111, so that the driven body 112 can be driven by the driving element 113 to rotate relative to the active body 111, so as to adjust an expansion angle between the driven body 112 and the active body 111. For example, the driving element 113 may be a motor, a combination of motor and gear, a combination of motor, gear and rack, or a combination of motor, pulley and drive belt, and can be operated under a control of the processor 140. The aforementioned motor may be a stepping motor, a DC motor or a servomotor, but the invention is not limited thereto.

On the other hand, the walking aid device 100 further includes a pair of drive assemblies 150 (i.e., two oppositely disposed drive assemblies 150) connected to the active body 111. Each of the drive assemblies 150 may be a combination of motor and wheel set, a combination of motor, gear and wheel set, or a combination of motor, pulley, drive belt and wheel set. The two drive assemblies 150 are respectively disposed at two opposite sides of the active body 111, and are respectively electrically coupled to the processor 140. Furthermore, the two drive assemblies 150 can respectively controlled by the processor 140 to operate independently to drive the active body 111 to move, and the driven body 112 is being guided by the active body 111 to move together. Because the two drive assemblies 150 can respectively be controlled by the processor 140 to operate independently, the moving body 110 can be changed in direction by controlling a rotation speed difference between the two drive assemblies 150, and is not limited to moving forward and backward.

The message receiving element 120 is configured to receive a message (e.g., sound) from the (i.e., target 10, please refer to FIG. 2), and the positioning element 130 is configured to locate a position of the moving body 110. In the present embodiment, the processor 140 is, for example, a Central Processing Unit (CPU), a System on Chip (SOC), other programmable general purpose or special purpose microprocessor, a Digital Signal Processor, (DSP), a programmable controller, an Application Specific Integrated Circuits (ASIC), a Programmable Logic Device (PLD), other similar processing device or a combination thereof. On the other hand, the moving body 110 may be configured with a storage device (not shown) therein, such as a Dynamic Random Access Memory (DRAM), a Flash memory or a Non-Volatile Random Access Memory (NVRAM), etc. and the storage device (not shown) and the processor 140 are electrically coupled and are configured to store the information described in each embodiment of the invention (such as, sound information, image information, position data or other information) for the processor 140 to access, calculate and execute.

The message receiving element 120 may include a plurality of directional microphones respectively facing towards different directions and configured to receive sounds from all directions. After the message receiving element 120 receive the message (e.g., sound) from the user (i.e., target 10, please refer to FIG. 2), the processor 140 can perform an analyzing operation to the message (e.g., sound) so as to obtain an orientation of the user (i.e., target 10, please refer to FIG. 2), and information regarding the orientation of the user (i.e., target 10, please refer to FIG. 2) can be stored in the storage device (not shown). On the other hand, the positioning element 130 can locate a position of the moving body 110 through positioning technology such as Global Positioning System (GPS), Wi-Fi, Radio Frequency Identification (RFID), ultrasound, ZigBee, Bluetooth or infrared, and information regarding the position of the moving body 110 can be stored in the storage device (not shown). Afterwards, the processor 140 can access the information stored in the storage device (not shown) and perform calculation according to the orientation of the user (i.e., target 10, please refer to FIG. 2) and the position of the moving body 110 so as to produce position data, and control the moving body 110 to move to where the user (i.e., target 10, please refer to FIG. 2) is located according to the position data.

For example, the position data may be map information around the user (i.e., target 10, please refer to FIG. 2) and the moving body 110, and based on the map information, the processor 140 can calculate and plan a best moving route. Next, the processor 140 can control the operation of the drive assembly 150 and drives the moving body 110 to move, thereby enabling the moving body 110 to move to where the user (i.e., target 10, please refer to FIG. 2) is located according to the best moving route.

Referring to FIG. 1 again, the walking aid device 100 further includes at least one image sensor 160, a seat 161, a handle 162, a proximity sensing element 163 and a tilt sensing element 164, wherein the image sensor 160 is disposed at one side of the active body 111 of the moving body 110, and electrically coupled to the processor 140. Here, the number of the image sensors 160 is two, and the two image sensors 160 are respectively disposed at two opposite sides of the active body 111 of the moving body 110, and respectively electrically coupled to the processor 140. In other embodiments, the number of the image sensors 160 may be more than two. The seat 161 and the handle 162 are respectively movably connected to the active body 111 of the moving body 110, wherein the two image sensors 160 are substantially located between the active body 111 and the seat 161, and the two image sensors 160 may be a 3D camera or a combination of camera and rangefinder (e.g., infrared rangefinder, ultrasonic rangefinder or laser rangefinder). An image of objects around the moving body 110 can be obtained through at least one of the image sensors 160, wherein image information can be stored in the storage device (not shown), and the processor 140 can access the image information stored in the storage device (not shown) and accordingly calculate and determine the distances, the orientations or the postures of the objects around the moving body 110. Thus, the image sensors 160 can also be configured to assist the moving body 110 to keep away from obstacles, so that the moving body 110 can smoothly move towards where the user (i.e., target 10, please refer to FIG. 2) is located according to the best moving route.

In other embodiment, the message receiving element may be a signal receiver, the user may send a signal via a signal transmitter (such as a transmitter) to the signal receiver, and after the signal receiver receives the signal from the signal transmitter, the processor can perform an analyzing operation on the signal to obtain the orientation of the user, and information regarding the orientation of the user can be stored in the storage device. On the other hand, the positioning element can locate the position of the moving body through positioning technology such as such as GPS, Wi-Fi, RFID, ultrasound, ZigBee, Bluetooth or infrared, and information regarding the position of the moving body 110 can be stored in the storage device (not shown). Afterwards, the processor can access the information stored in the storage device (not shown) and perform calculation according to the orientation of the user and the position of the moving body so as to produce the position data, and control the moving body to move to where the user is located according to the position data.

On the other hand, the walking aid device 100 further includes a first driving element 165 and a second driving element 166 respectively disposed at the actively body 111 of the moving body 110. The first driving element 165 may be a motor, a combination of motor and gear or a combination of motor, pulley and drive belt, which is configured to connect to the seat 161. The second driving element 166 may be a motor, a combination of motor and gear, or a combination of motor, pulley and drive belt, which is configured to connect to the handle 162. The first driving element 165 and the second driving element 166 are respectively electrically coupled to the processor 140, and can respectively operate under controls of the processor 140 so as to respectively drive the seat 161 and the handle 162 to rotate relative to the active body 111.

In the present embodiment, the handle 162 may include a first rod portion 162*a*, a second rod portion 162*b* and a grip portion 162*c*, wherein the first rod portion 162*a* connects to the second driving element 166, and the first rod portion 162*a* can be driven by the second driving element 166 to rotate relative to the active body 111. One of the two ends of the second rod portion 162*b* is rotatably connected to the second rod portion 162*b*, and the grip portion 162*c* is fixed at the other end of the second rod portion 162*b*. The grip portion 162*c* includes two grips 162*d*, wherein the walking aid device 100 further includes two pressure sensing elements 162*e* respectively disposed at the two grips 162*d* and a pressure sensing element 167 disposed at the seat 161. The two pressure sensing elements 162*e* may be a strain gauge or a pressure sensor, and is electrically coupled to the processor 140. On the other hand, the walking aid device 100 further includes a switch element 168, the switch element 168 may be a switch button or a touch element, and the switch element 168 is disposed at the grip portion 162*c* of the handle 162. The pressure sensing element 167 may be a strain gauge or a pressure sensor, and the pressure sensing element 167 and the switch element 168 are respectively electrically coupled to the processor 140.

The proximity sensing element 163 is disposed at the active body 111 and electrically coupled to the processor 140. The proximity sensing element 163 may be a proximity sensor, laser rangefinder or a 3D camera configured to detect obstacles around the moving body 110. In the present embodiment, the number of the proximity sensing element 163 may be a plurality so as to detect around the moving body 110 (including the ground). Furthermore, the processor 140 can control the moving body 110 to keep away from the obstacles during the process of moving after receiving information detected by the proximity sensing element 163, so that the moving body 110 can successfully move towards where the user (i.e., target 10, please refer to FIG. 2) is located according to the best moving route.

On the other hand, the tilt sensing element 164 is disposed at the active body 111 and electrically coupled to the processor 140. The tilt sensing element 164 may be a gravity sensor, a gyroscope or a ten-axis sensor configured to detect a tilt angle of the moving body 110. Furthermore, the processor 140 can control a rotation speed of the drive assembly 150 and a rotation direction of a wheel set in the drive assembly 150 after receiving information detected by the tilt sensing element 164, such as by enabling the moving body 110 to speed up at an uphill section or enabling the moving body 110 to slow down at a downhill section. Otherwise, it may enable the wheel set in the drive assembly 150 to turn to a reverse direction at the downhill section so as to avoid the speed of the moving body 110 from being too fast at the downhill section, or may stop the moving body 110.

Figure 2:
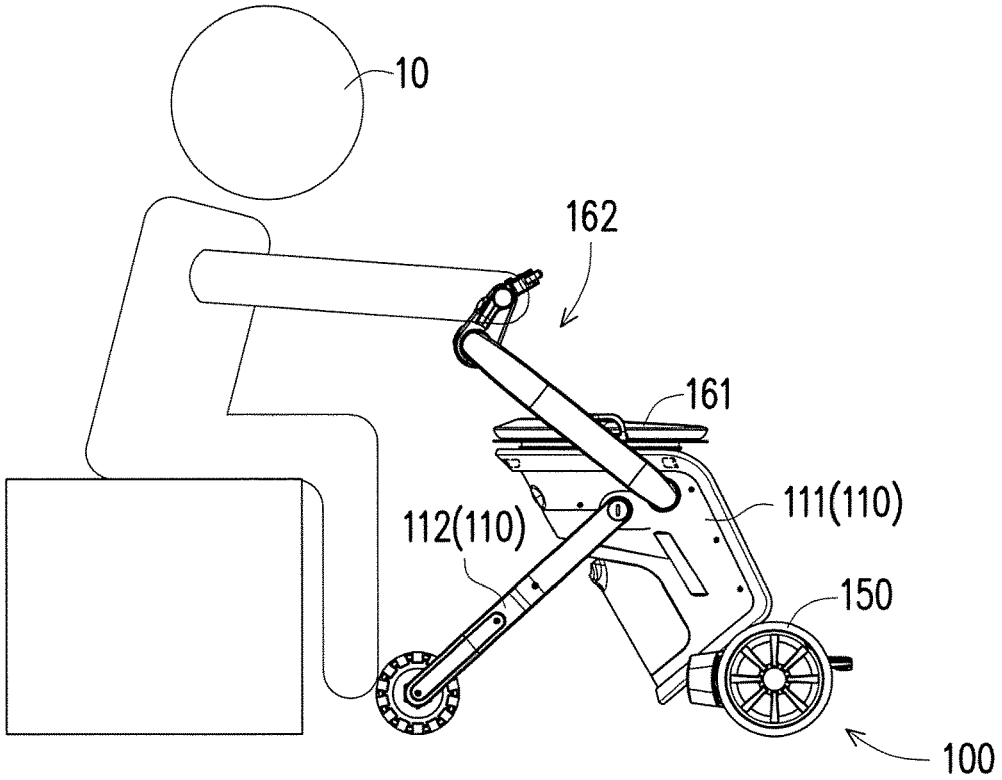
FIG. 2 is a schematic diagram illustrating the walking aid device of FIG. 1 moving to where a user is located.
Figure 3:
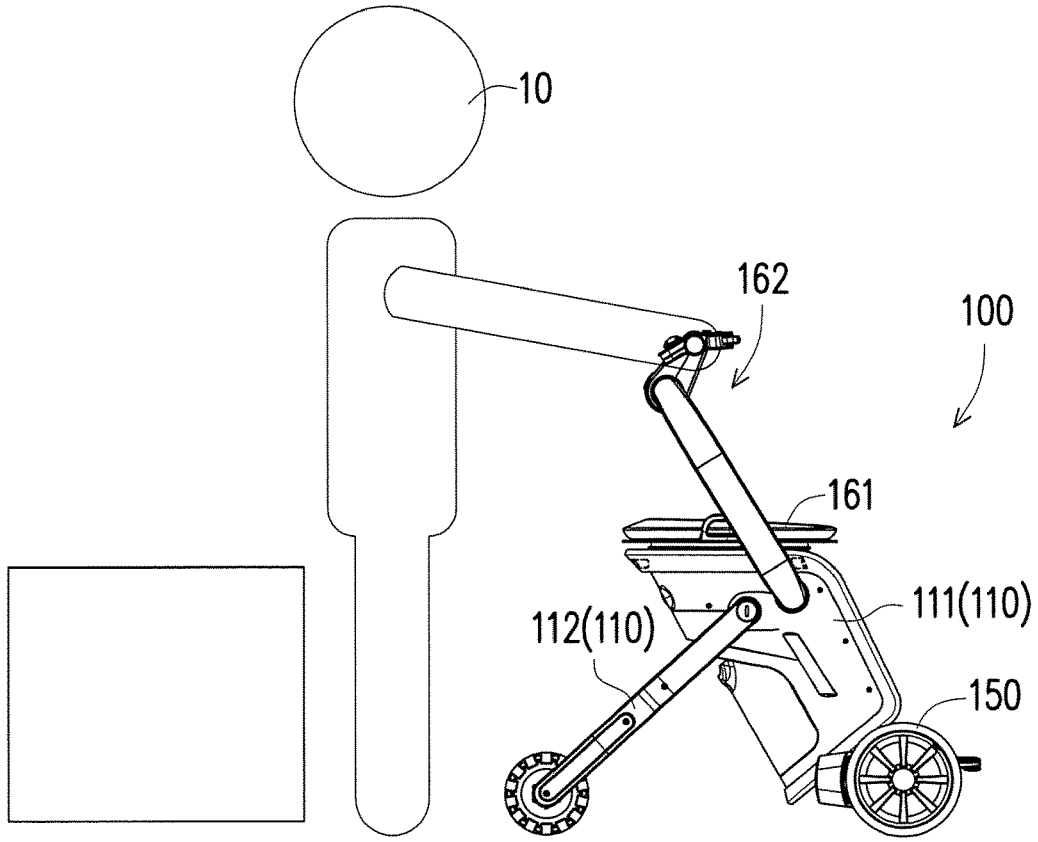
FIG. 3 is a schematic diagram illustrating the walking aid device of FIG. 2 assisting the user standing.
Figure 4:
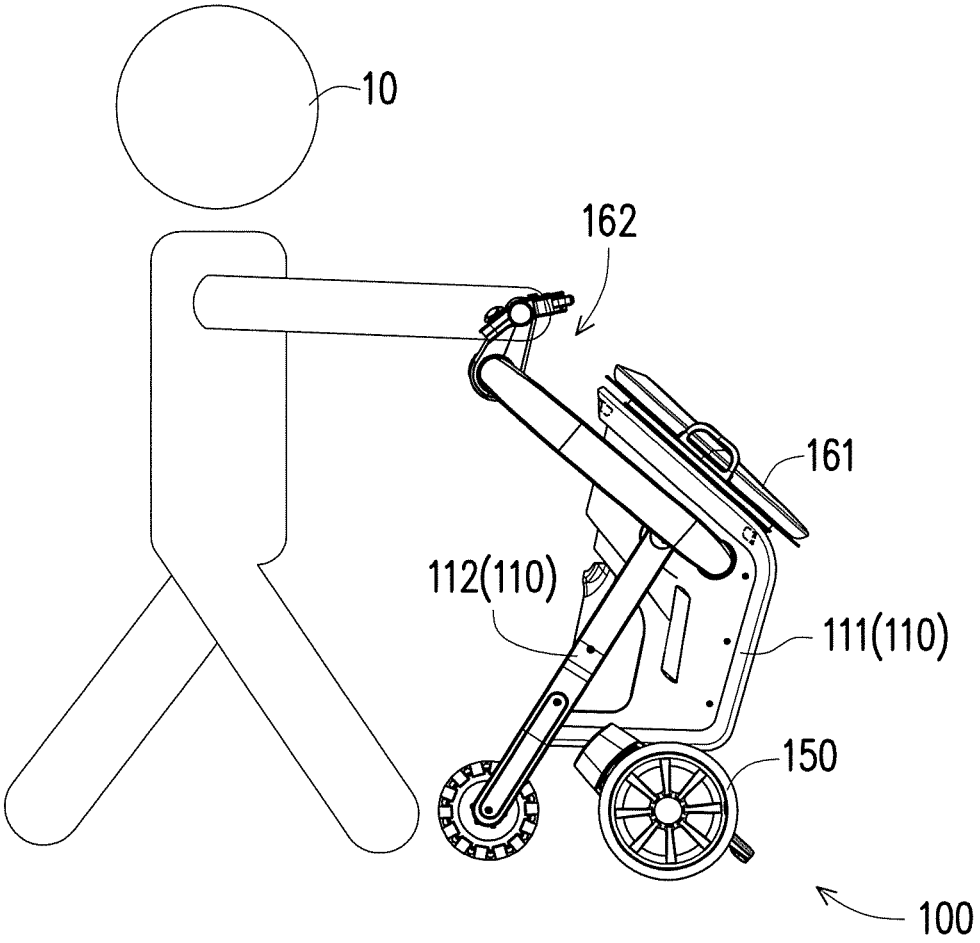
FIG. 4 is a schematic diagram illustrating the user walking with an assist of the walking aid device of FIG. 3.

FIG. 2 is a schematic diagram illustrating the walking aid device of FIG. 1 moving to where a user is located. FIG. 3 is a schematic diagram illustrating the walking aid device of FIG. 2 assisting the user standing. FIG. 4 is a schematic diagram illustrating the user walking with an assist of the walking aid device of FIG. 3. Referring to FIG. 1 through FIG. 4, after moving to where the user (i.e., target 10) is located, the walking aid device 100 firstly obtains an image of the user (i.e., target 10) via the image sensor 160 and determines the distance, the orientation or the posture of the user (i.e., target 10) via the processor 140, so that the moving body 110 can move with respect to the user (i.e., target 10) so as to adjust the relative positions of the moving body 110 and the user (i.e., target 10), and thus it is convenient for the user (i.e., target 10) to contact the walking aid device 100.

The user in a sitting posture as shown in (i.e., target 10) in FIG. 2 can touch the two pressure sensing elements 162*e* on the two grips 162*d* with both hands and apply pressures onto the two pressure sensing elements 162*e*; at this moment, the two pressure sensing elements 162*e* send electrical signals to the processor 140, and then, the processor 140 controls the second driving element 166 to operate to drive the handle 162 to rotate relative to the active body 111, so as to assist the user (i.e., target 10) to switch to the stance as shown in FIG. 3. The image sensor 160 can obtain an instance image of the user (i.e., target 10), thereby enabling the processor 140 to determine and known that the user (i.e., target 10) is standing.

If both hands of the user (i.e., target 10) hold on to the two grips 162*d* and respectively apply the pressures onto the two pressure sensing elements 162*e*, then the two pressure sensing elements 162*e* will send electrical signals to the processor 140, next, the processor 140 will control the second driving element 166 to operate to drive the handle 162 to rotate relative to the active body 111 and control the driving element 113 to operate to drive the driven body 112 to rotate relative to the active body 111, so as to adjust an expansion angle between the driven body 112 and the active body 111, thereby enabling the walking aid device 100 to transform to walking aid mode as shown in FIG. 4. Under the condition that the user (i.e., target 10) continually to apply the pressure onto the two pressure sensing elements 162*e* with both hands, the two pressure sensing elements 162*e* continuously send out the electrical signals to the processor 140, and at this moment, the processor 140 controls the drive assembly 150 to drive the moving body 110 to move, so that the user (i.e., target 10) can be guided by the walking aid device 100 to perform walking, as shown in FIG. 4.

Figure 5:
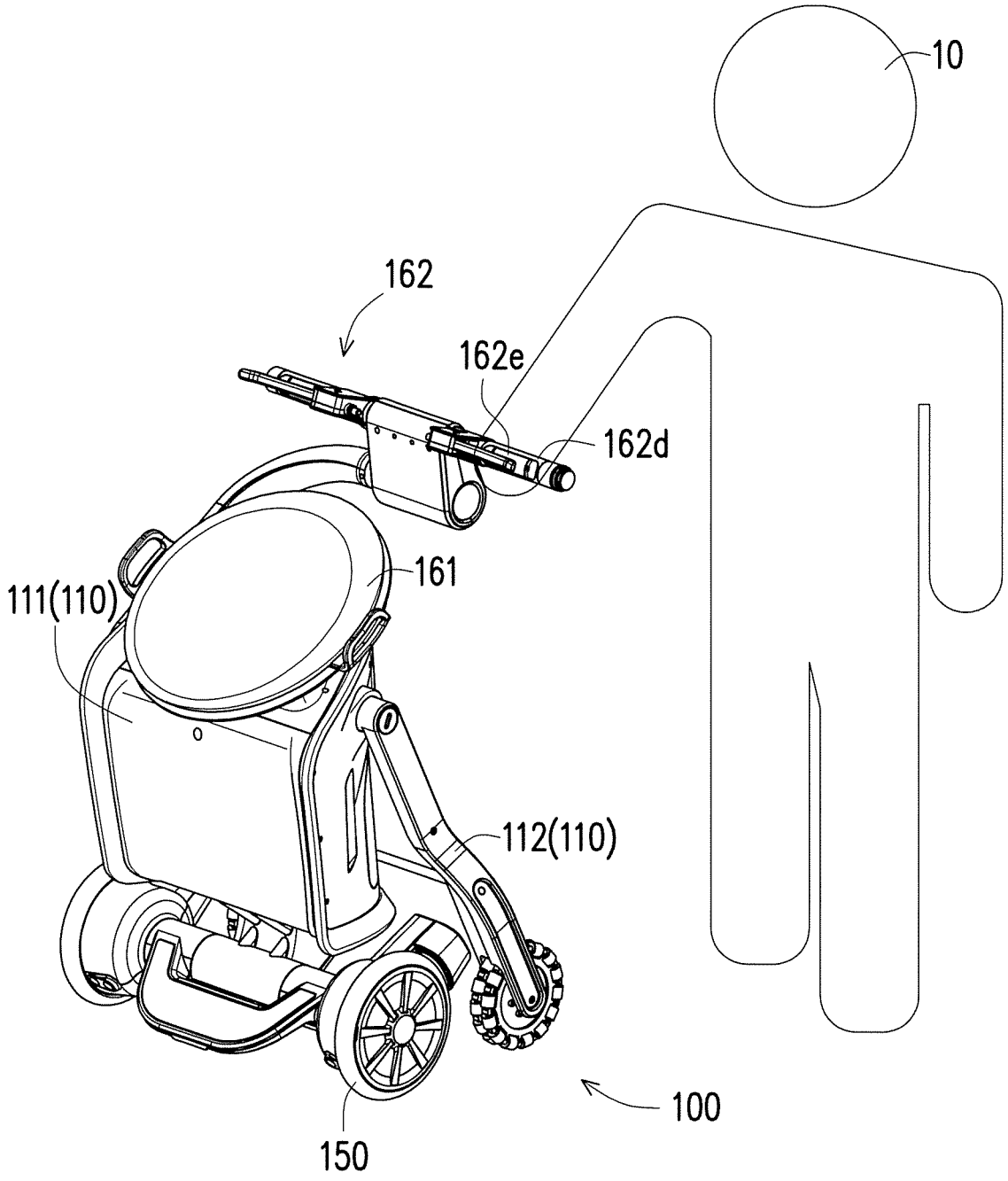
FIG. 5 through FIG. 7 illustrate a process of the user in FIG. 4 moving with respect to the walking aid device.
Figure 6:
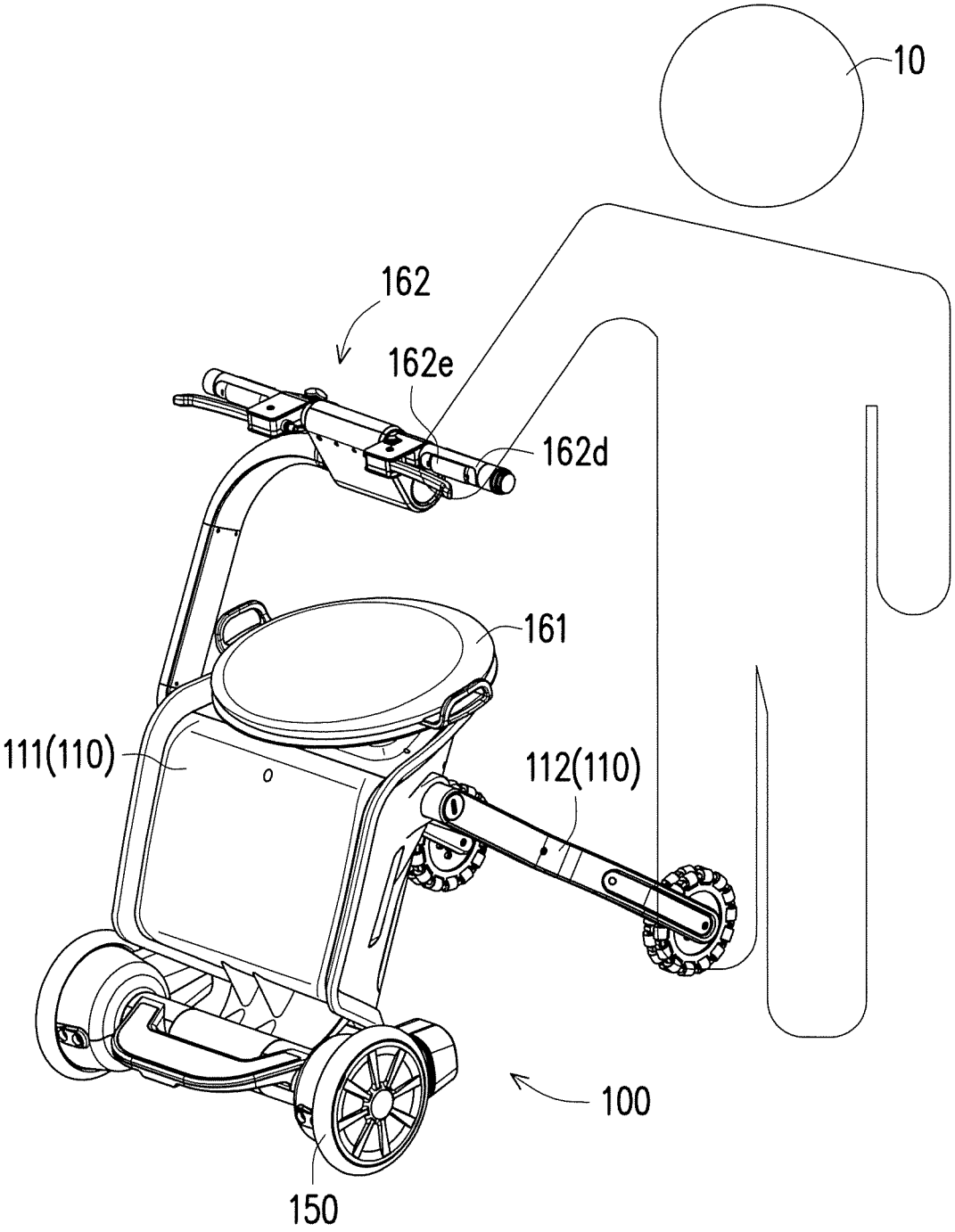
Figure 7:
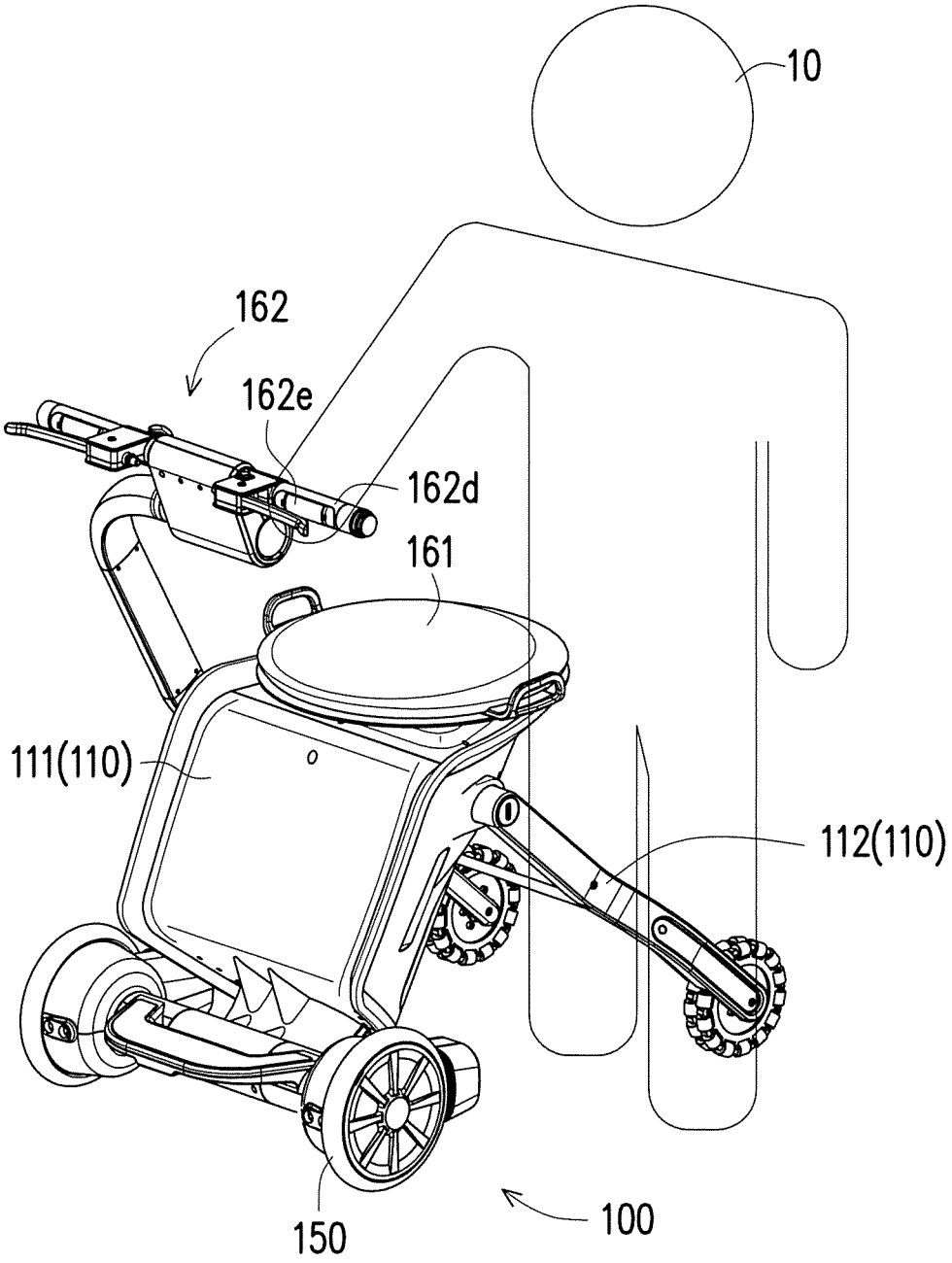

FIG. 5 through FIG. 7 illustrate a process of the user in FIG. 4 moving with respect to the walking aid device. Referring to FIG. 1 and FIG. 4, the user (i.e., target 10) in FIG. 4 is located at a side where the driven body 112 is located, and the user (i.e., target 10) may change to hold the single grip 162*d* with single hand to serve as a support to move around the moving body 110, as shown in FIG. 5 through FIG. 7. Under the condition that the user (i.e., target 10) holds the single grip 162*d* with the single hand, the processor 140 stops the operation of the drive assembly 150 to stop the walking aid device 100, and the image sensor 160 can obtain the instant image of the user (i.e., target 10) so that the processor 140 can determine and known the orientation and the posture of the user (i.e., target 10). Under the condition that the user (i.e., target 10) continue to apply pressure onto the pressure sensing element 162*e* of the single grip 162*d*, and as the orientation and the posture of the user (i.e., target 10) are changed, the processor 140 controls the driving element 113 to drive the driven body 112 to rotate relative to the active body 111 and controls the second driving element 166 to drive the handle 162 to rotate relative to the active body 111, so that during the process in which the user (i.e., target 10) moves around the moving body 110, the user (i.e., target 10) is able to hold the single grip 162*d* by one hand to use as the support, and will not fall down due to losing support. Finally, the walking aid device 100 can be transformed to a self-moving mode as shown in FIG. 7, so that that user (i.e., target 10) can ride on the walking aid device 100 to move forward.

Figure 8:
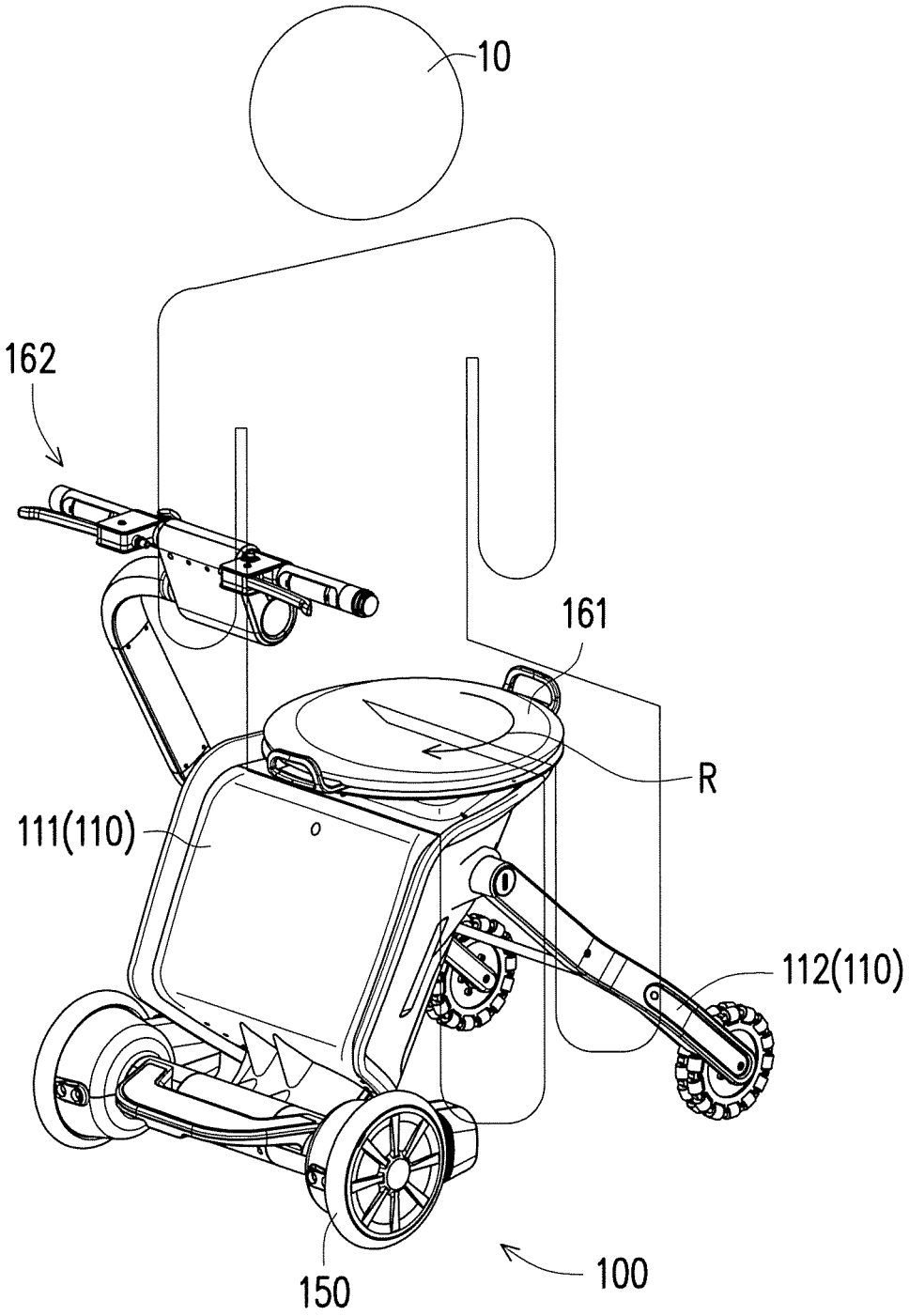
FIG. 8 and FIG. 9 illustrate a process of the user riding on the walking aid device.
Figure 9:
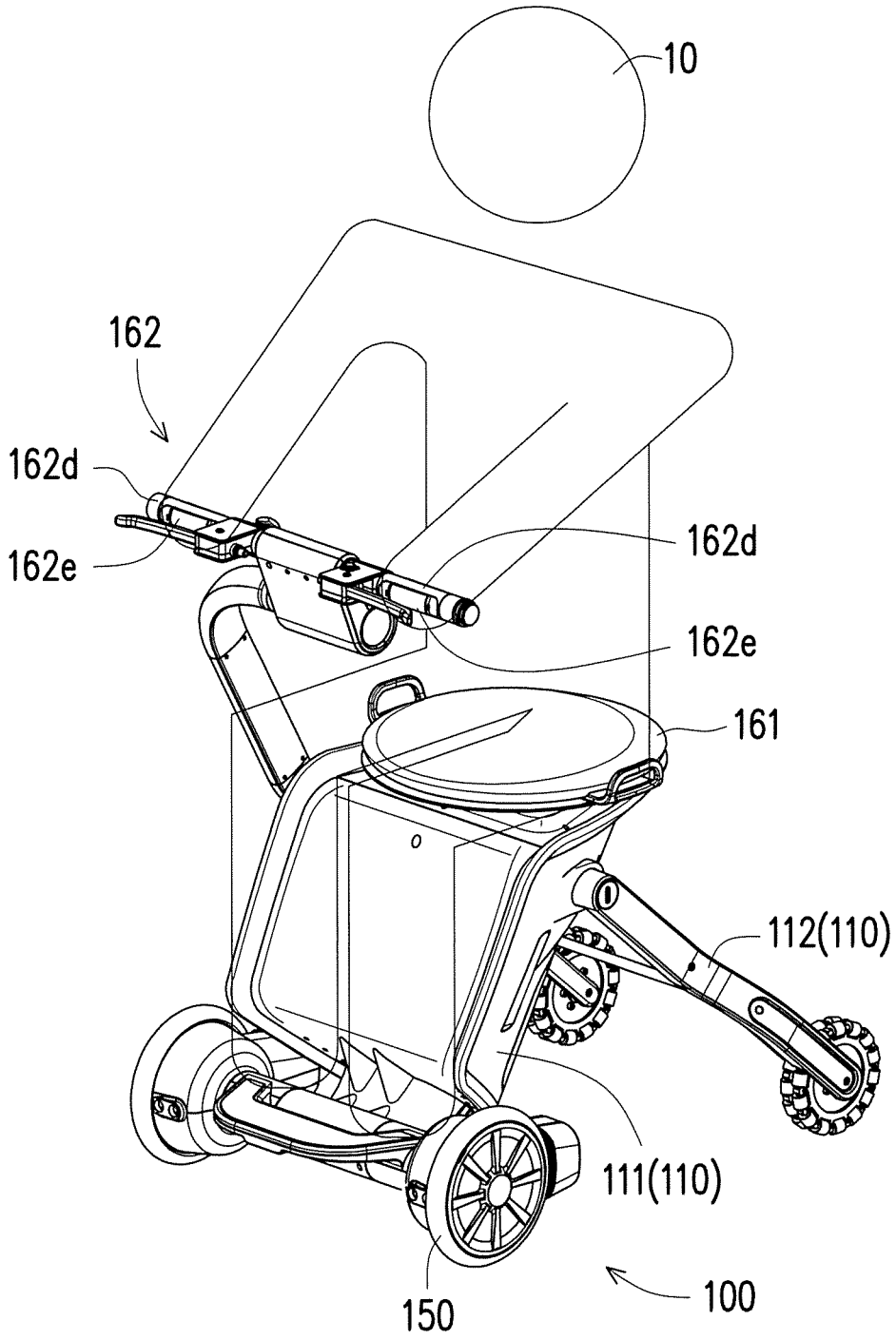

FIG. 8 and FIG. 9 illustrate a process of the user riding on the walking aid device. Referring to FIG. 1 and FIG. 7 through FIG. 9, after the walking aid device 100 transforms to the self-moving mode, the user (i.e., target 10) can ride on the seat 161; because the seat 161 is configured with the pressure sensing element 167, the pressure sensing element 167 as subjected to a pressure can send out an electrical signal to the processor 140, so as to determine whether the user (i.e., target 10) is seat onto a position for riding. Next, after the processor 140 determines that the user (i.e., target 10) is seat onto the position for riding, the processor 140 turns off the sensing function of the pressure sensing element 162*e* and controls the first driving element 165 to operate to drive the seat 161 to rotate relative to the actively body 111 along a rotation direction R (e.g., rotating 90 degrees). After the seat 161 rotates to the position, the user (i.e., target 10) faces towards the handle 162, and at this moment, the processor 140 turns on the sensing function of the pressure sensing element 162*e* again. It is to be particularly noted that, under the self-moving mode of FIG. 7, the user (i.e., target 10) currently continues to apply pressure onto the pressure sensing element 162*e* of the single grip 162*d*; if an armrest on the seat 161 obstructs the user (i.e., target 10) from sitting onto the seat 161, the processor 140 can control the first driving element 165 to operate to drive the seat 161 to rotate relative to the actively body 111 along a direction opposite to the rotation direction R (e.g., rotating 90 degrees), such that the seat 161 transforms from the state as shown in FIG. 7 to the state as shown in FIG. 8, so as to enable the user (i.e., target 10) to successfully sit onto the seat 161 without being obstructed by the armrest on the seat 161. For example, the image sensor 160 can be used to assist in determining whether the armrest on the seat 161 is obstructing the user (i.e., target 10) from sitting onto the seat 161.

During the process in which the seat 161 rotates relative to the active body 111, turning off the sensing function of the pressure sensing element 162*e* can prevent the walking aid device 100 from moving suddenly due to inadvertently triggering the pressure sensing element 162*e*, thereby reducing accidents. After the user (i.e., target 10) sits onto the riding position and faces towards the handle 162, the user (i.e., target 10) can hold the two grips 162*d* with both hands and respectively applies the pressures onto the two pressure sensing elements 162*e*; at this moment, the processor 140 receives the electrical signals from the two pressure sensing elements 162*e* and the electrical signal from the pressure sensing element 167 at the same time, so as to control the operation of the drive assembly 150 and drive the moving body 110 to move. That is to say, when the two pressure sensing elements 162*e* are both not under pressure, the moving body 110 is stopped from moving. For example, by changing the pressures applied onto the two pressure sensing elements 162*e*, the processor 140 can determine according to a preset value to control the moving body 110 to move forward or backwards, or to enable the two drive assemblies 150 to produce a rotational difference to cause the moving body 110 to change direction.

On the other hand, after the switch element 168 is activated, the processor 140 turns off the sensing function of the pressure sensing element 162*e* and stops the moving body 110 from moving, and then controls the first driving element 165 to drive the seat 161 to rotate relative to the active body 111 along the direction opposite to the rotation direction R (e.g., rotating 90 degrees), until after the seat 161 rotates into position and the pressure applied onto the pressure sensing element 167 on the seat 161 is removed (i.e., after the user left the seat 161), the processor 140 turns on the sensing function of the pressure sensing element 162*e* again. During the process of the seat 161 rotating relative to the active body 111, turning off the sensing function of the pressure sensing element 162*e* can prevent the walking aid device 100 from moving suddenly due to inadvertently triggering the pressure sensing element 162*e*, thereby preventing the user (i.e., target 10) from falling off when leaving the walking aid device 100.

Figure 10:
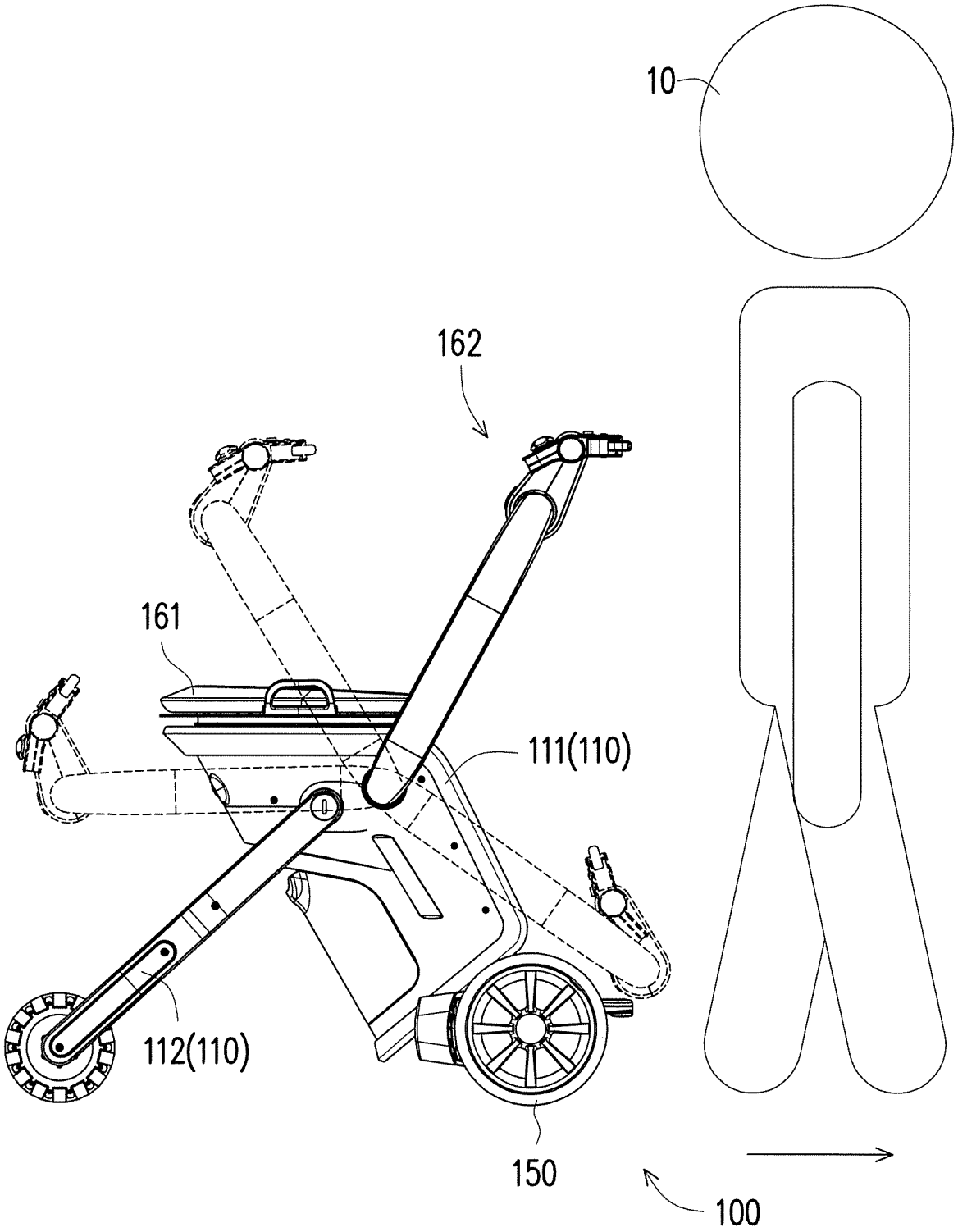
FIG. 10 is a schematic diagram illustrating the user in FIG. 9 moving to any side of the walking aid device.

FIG. 10 is a schematic diagram illustrating the user in FIG. 9 moving to any side of the walking aid device. Referring to FIG. 1, FIG. 9 and FIG. 10, after the user (i.e., target 10) leaves the walking aid device 100, the image sensor 160 can obtain the instant image of the user (i.e., target 10), and then the processor 140 can determine to known the distance, the orientation and the posture of the user (i.e., target 10). If the user (i.e., target 10) sends a command to request the walking aid device 100 to follow along, then after the message receiving element received the command sent from the user (i.e., target 10), the processor 140 will control the moving body 110 to move along with the user (i.e., target 10) according to the command. On the other hand, the image sensor 160 and the proximity sensing element 163 allow the walking aid device 100 to keep a safe distance from the user (i.e., target 10) during the accompanying process, so as to avoid colliding with the user (i.e., target 10) or interfering with the user (i.e., target 10) walking. It is to be particularly noted that, under the accompanying mode, the walking aid device 100 can change a state of it handle 162 based on the needs, and FIG. 10 illustrates different states of the handle 162 with dashed lines.

Figure 11:
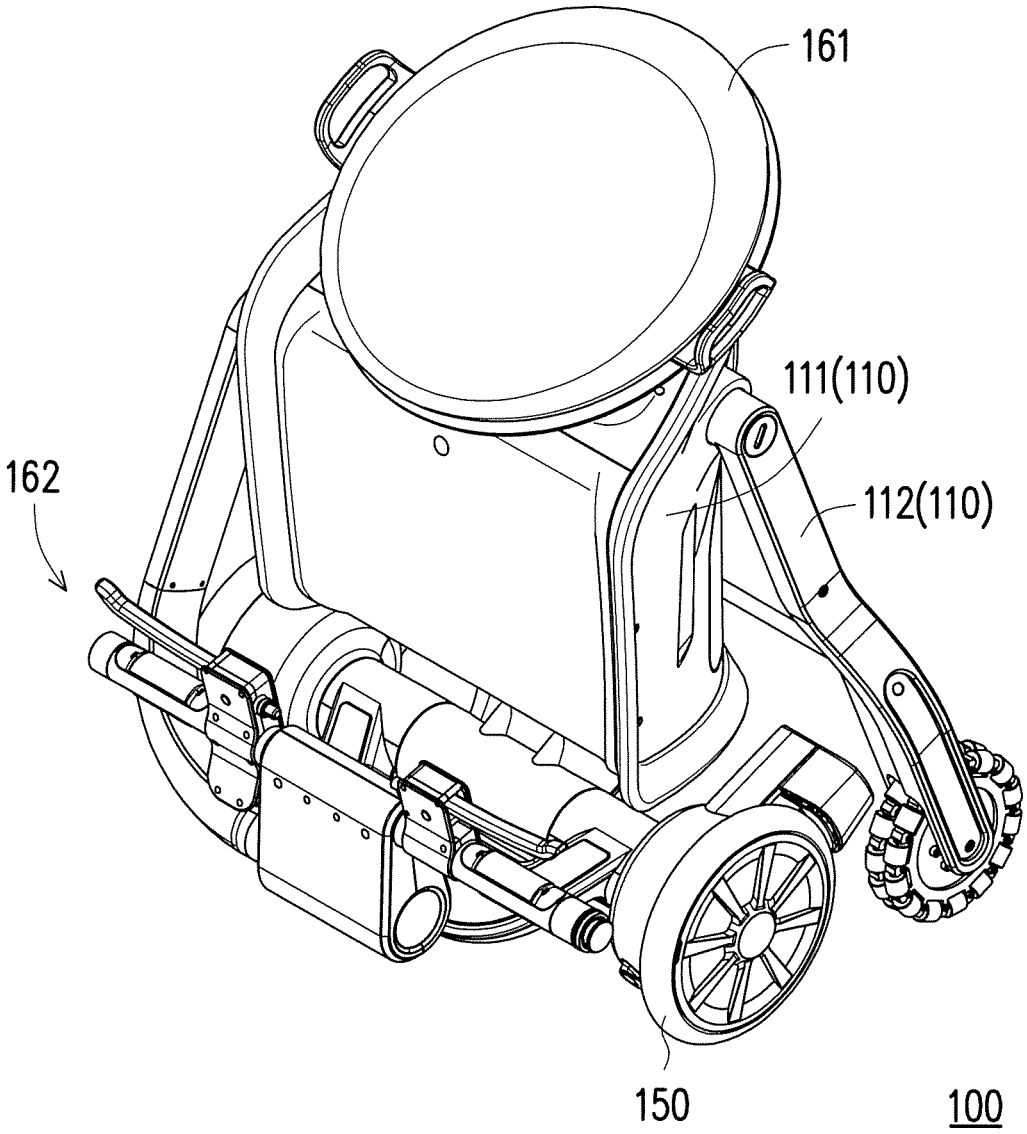
FIG. 11 is a schematic diagram illustrating the walking aid device of FIG. 1 transforming to a storage mode.

FIG. 11 is a schematic diagram illustrating the walking aid device of FIG. 1 transforming to a storage mode. Referring to FIG. 1 and FIG. 11, in the present embodiment, the pressure sensing element 162*e* on the handle 162 and the pressure sensing element 167 on the seat 161 are both not under pressure, and after the walking aid device 100 stays stationary for some time, the processor 140 automatically controls the driving element 113 to operate to enable the driven body 112 to rotate relative to the active body 111 and controls the second driving element 166 to operate to enable the handle 162 to rotate relative to the active body 111, so as to transform to the storage mode as shown in FIG. 11.

For example, when the user (i.e., target 10) intends to use the walking aid device 100 again, the user can apply a pressure onto the pressure sensing element 162*e* of the handle 162 or the pressure sensing element 167 on the seat 161, or other switch element, so as to enable the processor 140 to control the walking aid device 100 to transform from the storage mode as shown in FIG. 11 to an appropriate use mode. In addition to the aforementioned approach, the instant image of the user (i.e., target 10) may also be obtained through the image sensor 160, and after the processor 140 determines the distance, the orientation and the posture of the user (i.e., target 10), the walking aid device 100 can be controlled to transform from the storage mode as shown in FIG. 11 to the appropriate use mode.

Figure 12:
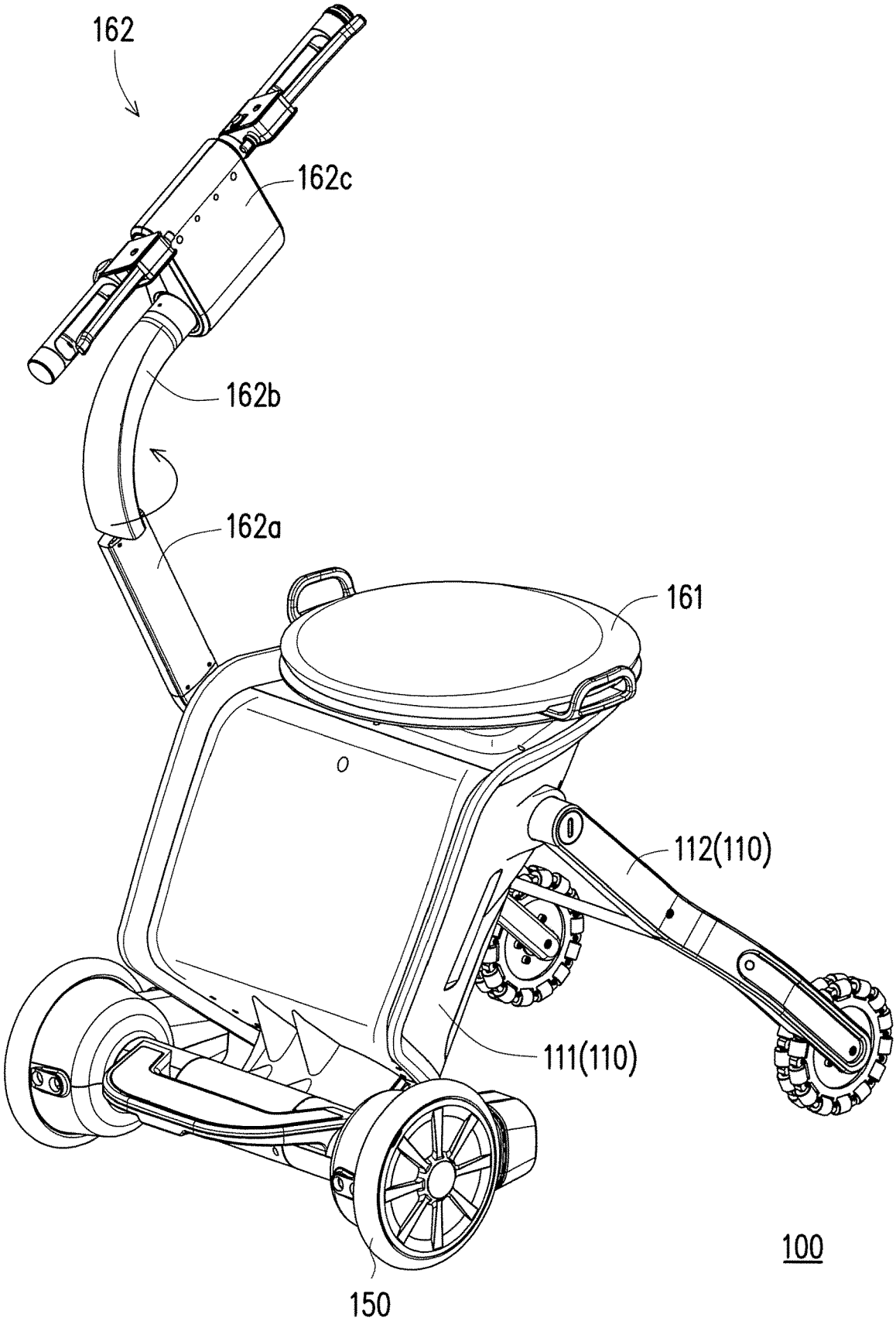
FIG. 12 is a schematic diagram illustrating the walking aid device under a different mode according to an embodiment of the invention.

FIG. 12 is a schematic diagram illustrating the walking aid device under a different mode according to an embodiment of the invention. Referring to FIG. 1, FIG. 5 and FIG. 12, in the present embodiment, under the mode as shown in FIG. 5, the user (i.e., target 10) can only sit onto the seat 161 from one of the sides of the walking aid device 100. By enabling the second rod portion 162*b* to rotate relative to the first rod portion 162*a* to enable the walking aid device 100 to transform to the mode as shown in FIG. 12, the user (i.e., target 10) can sit onto the seat 161 from at least two sides of the walking aid device 100. In other embodiments, the processor may be used to control the operation of the second driving element to enable the handle to rotate relative to the active body, and to move close to the driven body; at this moment, the user (i.e., target) can sit onto the seat from at least three sides of the walking aid device.

In summary, the walking aid device of the invention can be controlled by the message from the target (e.g., a user) to move automatically from the far away to where the target is located, or to move along the target (e.g., a user), and thus is extremely convenient to use. On the other hand, the user may also use methods as pressure control or image control to enable the walking aid device to automatically switch the use modes or the operation states, that is, the walking aid device of the invention is a multifunctional walking aid device which can meet a variety of needs of the user.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A walking aid device, comprising:

a moving body, the moving body has a seat and a handle;

a message receiving element, disposed at the moving body and configured to receive a message from a target;

a positioning element, disposed at the moving body and configured to locate a position of the moving body; and a processor, disposed at the moving body and electrically coupled to the message receiving element and the positioning element, wherein when the message receiving element receives the message from the target, the processor determines an orientation of the target according to the message, and the positioning element locates the position of the moving body, the processor produces a position data according to the orientation of the target and the position of the moving body, and controls the moving body to move to where the target is located according to the position data, and controls the seat or the handle to rotate according to the message.

2. The walking aid device as recited in claim 1, further comprising:

at least one image sensor, disposed at one side of the moving body and electrically coupled to the processor, wherein the at least one image sensor is configured to obtain an image of the target, the processor determines a distance, an orientation or a posture of the target according the image of the target obtained by the at least one image sensor.

3. The walking aid device as recited in claim 2, wherein the seat and the handle are movably connected to the moving body.

4. The walking aid device as recited in claim 3, further comprising:

a first driving element, disposed at the moving body and connected to the seat to drive the seat to rotate relative to the moving body, wherein the first driving element is electrically coupled to the processor; and a second driving element, disposed at the moving body and connected to the handle to drive the handle to rotate relative to the moving body, wherein the second driving element is electrically coupled to the processor.

5. The walking aid device as recited in claim 4, further comprising:

a pressure sensing element, disposed at the seat and electrically coupled to the processor, wherein when the target applies a pressure onto the pressure sensing element, the processor controls the first driving element to drive the seat to rotate relative to the moving body according to a pressure value detected by the pressure sensing element.

6. The walking aid device as recited in claim 4, further comprising:

a pressure sensing element, disposed at the handle and electrically coupled to the processor, wherein when the target applies a pressure onto the pressure sensing element, the processor controls the second driving element to drive the handle to rotate relative to the moving body according to a pressure value detected by the pressure sensing element.

7. The walking aid device as recited in claim 4, further comprising:

a pressure sensing element, disposed at the handle and electrically coupled to the processor, wherein when the target applies a pressure onto the pressure sensing element, the processor controls the second driving element to drive the handle to rotate relative to the moving body according to a pressure value detected by the pressure sensing element and the orientation and the posture of the target.

8. The walking aid device as recited in claim 4, further comprising:

a first pressure sensing element, disposed at the seat and electrically coupled to the processor; and a second pressure sensing element, disposed at the handle and electrically coupled the processor, wherein when the target applies a pressure onto the first pressure sensing element, the processor turns off a sensing function of the second pressure sensing element according to a pressure value detected by the first pressure sensing element and controls the first driving element to drive the seat to rotate relative to the moving body along a rotation direction, and until the seat rotates into position, the processor turns on the sensing function of the second pressure sensing element again, when the target simultaneously applies pressures onto the first pressure sensing element and the second pressure sensing element, the processor controls the moving body to move according to a pressure value detected by the first pressure sensing element and a pressure value detected by the second pressure sensing element.

9. The walking aid device as recited in claim 8, further comprising:

a switch element, disposed at the handle and electrically coupled to the processor, wherein after the switch element is activated, the processor turns off the sensing function of the second pressure sensing element and stops the moving body from moving, and then controls the first driving element to drive the seat to rotate relative to the moving body along a direction opposite to the rotation direction, and until the seat rotates into position and the pressure applied onto the first pressure sensing element is removed, the processor turns on the sensing function of the second pressure sensing element again.

10. The walking aid device as recited in claim 2, wherein after the processor determines the distance, the orientation or the posture of the target according to the image of the target obtained by the at least one image sensor while the message receiving element receives a command sent out by the target, the processor controls the moving body to move along the target according to the command.

11. The walking aid device as recited in claim 1, wherein the moving body comprises an active body, a driven body and a driving element, and the driven body is pivoted on the active body, wherein the driving element is connected to the driven body and the active body, the driving element is electrically coupled to the processor, the driving element is configured to drive the driven body to rotate relative to the active body so as to adjust an expansion angle between the driven body and the active body.

12. The walking aid device as recited in claim 11, further comprising:

a pair of drive assemblies, connected to the active body and electrically coupled to the processor, and the pair of drive assemblies operates under a control of the processor to drive the active body to move.

13. The walking aid device as recited in claim 11, further comprising:

a proximity sensing element, disposed at the active body and electrically coupled to the processor, and the proximity sensing element is configured to detect obstacles around the moving body.

14. The walking aid device as recited in claim 11, further comprising:

a tilt sensing element, disposed at the active body and electrically coupled to the processor, and the tilt sensing element is configured to detect a tilt angle of the moving body.

15. The walking aid device as recited in claim 1, wherein the position data comprises a map information around the target and the moving body.

* * * * *